US009360820B2

(12) United States Patent
Pearce et al.

(10) Patent No.: US 9,360,820 B2
(45) Date of Patent: Jun. 7, 2016

(54) SINGLE BLOWER PROVIDING COOLING AND AIR KNIFE

(71) Applicant: Xerox Corporation, Norwalk, CT (US)

(72) Inventors: Christopher Pearce, Stevenage (GB); Christopher Francois David Watts, St. Albans (GB); Simon Neil Jowett, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/522,115

(22) Filed: Oct. 23, 2014

(65) Prior Publication Data

US 2016/0116885 A1 Apr. 28, 2016

(51) Int. Cl.
*G03G 15/00* (2006.01)
*G03G 21/20* (2006.01)

(52) U.S. Cl.
CPC ..... *G03G 15/657* (2013.01); *G03G 21/206* (2013.01)

(58) Field of Classification Search
CPC ..... G03G 15/567
USPC ..... 399/307, 397, 400
See application file for complete search history.

(56) References Cited

U.S. PATENT DOCUMENTS

| | | | | |
|---|---|---|---|---|
| 3,901,591 | A * | 8/1975 | Mitsumasu | |
| 5,223,903 | A * | 6/1993 | Russel et al. | 399/400 |
| 6,669,187 | B1 | 12/2003 | Clark | |
| 7,054,572 | B2 | 5/2006 | Baruch et al. | |
| 7,505,723 | B2 | 3/2009 | Roof | |
| 7,726,649 | B2 | 6/2010 | Domoto et al. | |
| 8,126,347 | B2 | 2/2012 | Kladias et al. | |
| 8,135,321 | B2 | 3/2012 | Ruiz et al. | |
| 8,265,505 | B2 | 9/2012 | Mills, III et al. | |
| 2005/0156377 | A1 | 7/2005 | Jacobs | |

FOREIGN PATENT DOCUMENTS

| | | | |
|---|---|---|---|
| JP | 09040204 | A * | 2/1997 |
| JP | 2008268597 | A * | 11/2008 |
| JP | 2013231798 | A * | 11/2013 |

* cited by examiner

*Primary Examiner* — Walter L Lindsay, Jr.
*Assistant Examiner* — Milton Gonzalez
(74) *Attorney, Agent, or Firm* — Gibb & Riley, LLC

(57) ABSTRACT

Printing apparatuses include, among other components, a media path transporting sheets of print media in a process direction. A transfer station is located at a first location of the media path, and a fusing station is located at a second location of the media path (the second location is closer to the end of the media path (in the process direction) relative to the first location). Also, a single blower is located adjacent the fusing station, and two outlets receive air from the single blower. A first outlet (of the two outlets) provides air to the transfer station to reduce the temperature of the transfer station, and a second outlet (of the two outlets) is located between the transfer station and the fusing station and directs the sheets of print media toward one side of the media path.

20 Claims, 7 Drawing Sheets

SINGLE BLOWER PROVIDING COOLING AND AIR KNIFE

BACKGROUND

Systems and methods herein generally relate to printing devices, and more particularly to utilization of pressurized airflow within such devices.

Printing devices often utilize pressurized airflow to assist many operations, such as cooling. Fixed geometry paper paths lead to a general tendency in terms of paper trajectory, but an outlying paper type may be problematic and clash with the structure of the paper path. Image quality marks on the prints and physical damage to the print cartridge due to poor paper trajectory from transfer nip to fuser nip are some results of media sheets not following the correct path within printing devices. Typically star wheels and guides are employed to re-direct the paper pre fuser, however these may result in other image quality (IQ) defects such as smear.

SUMMARY

Printing apparatuses herein include, among other components, a media path transporting sheets of print media in a process direction. A transfer station is located at a first location of the media path, and a fusing station is located at a second location of the media path (the second location is closer to the end of the media path (in the process direction) relative to the first location).

Also, a single blower is located adjacent the fusing and transfer stations, and two outlets receive air from the single blower. More specifically, ducting is connected to the single blower, and a first outlet and a second outlet are openings within the surface of the ducting. The first outlet (of the two outlets) provides air to the transfer station to reduce the temperature of the transfer station, and the second outlet (of the two outlets) is located between the transfer station and the fusing station and directs the sheets of print media toward one side of the media path. The transfer station is heated during printing operations (e.g., by radiant heat from the fuser and other components), and the first outlet cools the transfer station to dissipate such heat, while the second outlet acts as an air knife to properly position the print media within the media path.

Such printing apparatuses can include a valve located between the single blower and the second outlet, and a processor operatively (meaning directly or indirectly) connected to the valve. The processor controls the valve to cause the second outlet to selectively direct only identified types of the sheets of print media toward one side of the media path.

The transfer station and the fusing station are separated by a distance that is less than a length of the sheets of print media, and the transfer station and the fusing station operate at different sheet feeding speeds, which forms a buckle in the sheets of print media. The second outlet directs the sheets of media into a position to properly form such a buckle.

These and other features are described in, or are apparent from, the following detailed description.

BRIEF DESCRIPTION OF THE DRAWINGS

Various exemplary systems and methods are described in detail below, with reference to the attached drawing figures, in which the same numbers represent the same or similar components, where.

DETAILED DESCRIPTION

Figure 1:
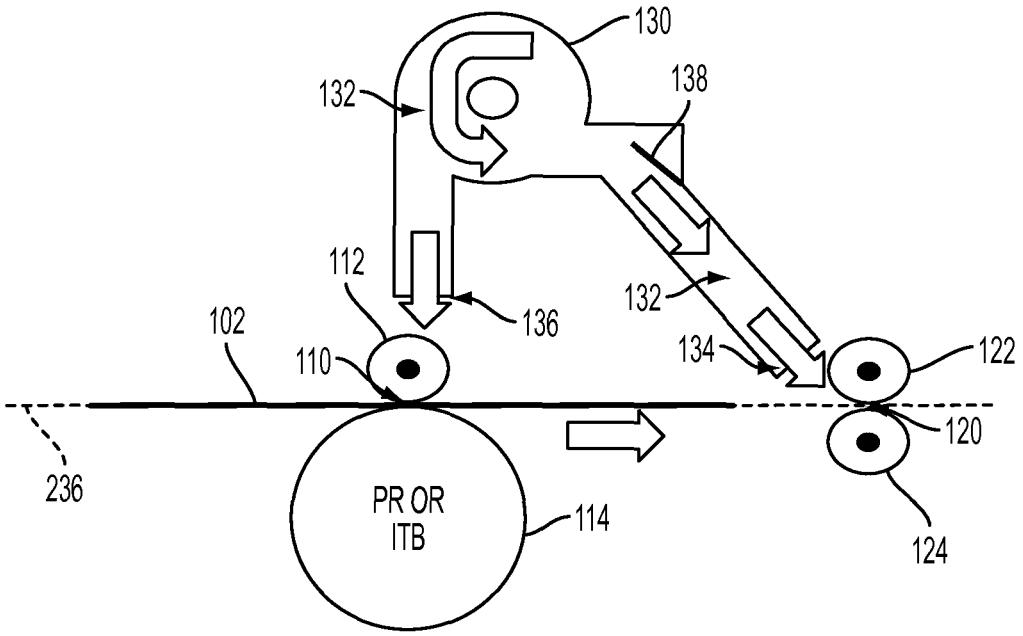
FIG. 1 is a schematic diagram illustrating devices herein.

As mentioned above, image quality marks on the prints and physical damage to the print cartridge due to poor paper trajectory from transfer nip to fuser nip are some results of media sheets not following the correct path within printing devices. Therefore, constrained or tight paper path geometry, specifically between the transfer nip and fusing nip, will lead to necessary compromises where ranges of paper weights and/or paper sizes are used. Creating printing devices that are robust to any type or size of print media is very challenging with a fixed geometry paper path.

With printing devices, the lead edge of the page leaves the transfer nip travelling up in a vertical paper path and naturally tends toward a first side of the media path, and the lead edge then touches the fuser guide first side and tacks to the fuser nip. As the rotational speeds of the transfer and fuser nips differ slightly a small buckle toward the first side (curvature in the page) is formed. The range of paper sizes, weights and beam strengths of print media that are used within printing devices occasionally results in a media type that does not conform to the ideal media type and, given that the paper path is fixed, the page tracks to an undesirable second side of the media path, which causes the print media to strike components, either causing or leading to physical damage to the components or disturbing the image on the page and creating image quality defects.

To keep the print media biased toward the desirable first side of the media path, the devices herein utilize an air jet or blade that targets the lead edge of the sheet as it exits the transfer nip. The air jet guides the leading edge of the print media sheet to the first side in the paper path and away from internal structures, and this naturally forms an ideal buckle toward the first side. More specifically, the devices herein include an air guide over the top of the print cartridge, which takes in air at the top from a cooling duct, and directs jets and blades of air at the incoming paper edge.

Issues with trailing edge flick are also countered by the air knife. Specifically, some air is allowed to flow across the top of the air guide and target the trail edge of the sheet of media just before it enters the fuser nip, again imparting enough force to push the page image side away from the undesirable fuser guide second side.

Additionally, with printing devices that maintain an identification of the type of print media in use, the control system is optimized further to only activate the air knife when problem paper types are being processed, and the air knife can remain off for normal use. Additionally, the flow rates are adjusted through fan speed control to increase the air pressure outputs from the air knife for difficult media requiring an extra force.

FIGS. 1-10 illustrate various aspects of printing devices (apparatuses) herein that can include, among other components, a printing engine 240 and a sheet path 236 feeding sheets of media 102 (e.g., paper, transparencies, card stock, plastics, cardboard, etc.) to the printing engine. The sheet path 236 can include, for example, various driven nips 110, 120

(between closely spaced opposing rollers 112/114, 122/124 (one or more of which may be driven by a motor or actuator)) such as a transfer nip 110 (first nip) at a first location of the sheet path, and a fusing nip 120 (second nip) at a second location of the sheet path.

For example, the transfer nip 110 is formed between opposing rollers 112, 114, at least one of which is powered by a motor. As is understood by those ordinarily skilled in the art, the transfer nip 110 (of the transfer station) is formed between pressure roller 112 and a transfer device 114 that contains marking material that is to be transferred to the sheet of media 102. For example, the transfer device 114 can comprise a photoreceptor (PR), an intermediate transfer belt (ITB), or any other surface that contains patterned marking material (e.g., toners, liquid or solid inks, etc.) that is to be transferred to the sheet of media 102. The pressure roller 112 or the transfer device 114 can be powered by one or more motors.

Similarly, the fuser nip 120 is formed between opposing rollers 122, 124, at least one of which is heated, and at least one of which is powered by a motor. As is understood by those ordinarily skilled in the art, the heat and pressure supplied by the opposing rollers 122, 124 at the nip 120 permanently binds the marking material to the print media.

Figure 2:
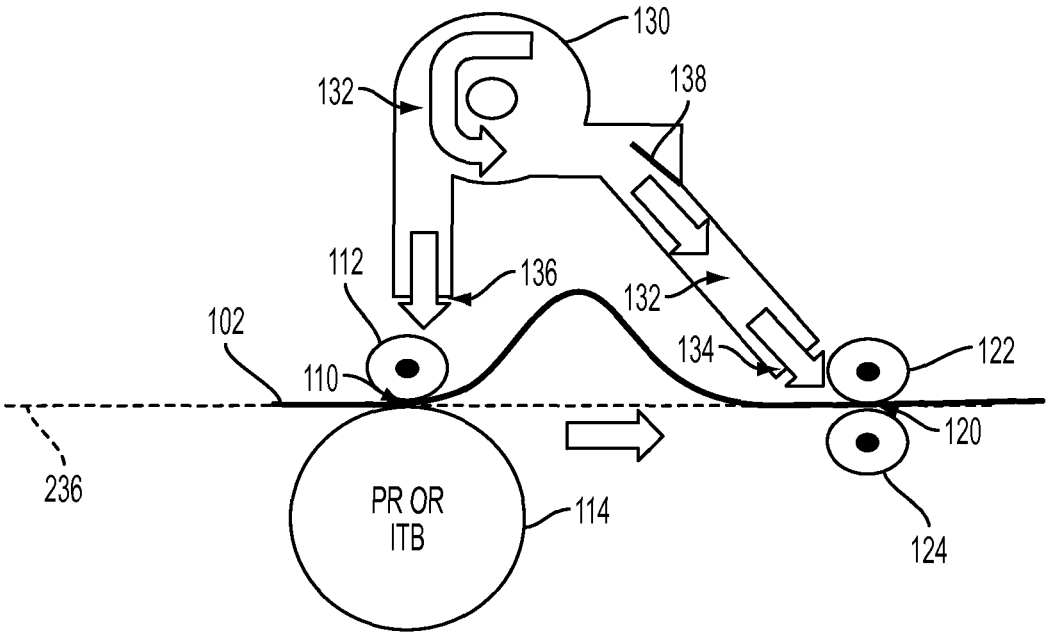
FIG. 2 is a schematic diagram illustrating devices herein.

The printing devices herein also include at least one speed control circuit 224 (shown in FIG. 7) that controls the sheet feeding speeds of the transfer nip 110 and the fusing nip 120. The transfer nip 110 and the fusing nip 120 are separated by a distance that is less than a length of the sheets of print media, and the transfer nip 110 and the fusing nip 120 can operate at different sheet feeding speeds, which can form a buckle in the sheet of print media, as shown in FIG. 2. The second outlet 134 directing the sheets of media into a position to properly form such a buckle. Thus, as shown in FIG. 2, the speed control circuit 224 can maintain the transfer nip 110 at a faster sheet feeding speed relative to the fusing nip 120 to develop a buckle in the media sheet 102.

Thus, as shown in FIGS. 1 and 2, a transfer nip 110 is located at a first location of the media path 236, and a fusing nip 120 is located at a second location of the media path 236 (the second location is closer to the end (the right side of FIGS. 1 and 2) of the media path (in the process direction shown by the block arrow below the sheet of media 102 in FIGS. 1 and 2) relative to the first location).

Also, a single blower 130 is located adjacent the fusing nip 120, and two outlets 134, 136 receive air from the single blower 130. More specifically, ducting 132 is connected to the single blower 130, and a first outlet 136 and a second outlet 134 are openings within the surface of the ducting 132. Block arrows within the ducting 132 represents airflow and, more technically, an area of increased air pressure relative to the air pressure exterior to the ducting 132, resulting in airflow out of the outlets 134, 136.

The first outlet 136 (of the two outlets) provides air to the transfer nip 110 to reduce the temperature of the transfer nip 110, and the second outlet 134 (of the two outlets) is located between the transfer nip 110 and the fusing nip 120 and directs the sheets of print media toward one side of the media path. The transfer nip 110 is heated during printing operations (e.g., by radiant heat from the fuser and other components), and the first outlet 136 cools the transfer nip 110 to dissipate such heat, while the second outlet 134 acts as an air knife to properly position the print media within the media path 236.

Such printing apparatuses can include a valve 138 located between the single blower 130 and the second outlet 134, and a processor operatively (meaning directly or indirectly) connected to the valve 138. The processor controls the valve to cause the second outlet 134 to selectively direct only identified types of the sheets of print media toward one side of the media path. Therefore, print media exceeding previously established limits on paper weight, thickness, stiffness, length, etc., will cause the processor 224 to open the valve 138 so as to cause airflow out of the second outlet 134 to help maintain the print media that exceeds the previously established limits within the proper location of the media path 236. For example, in FIGS. 1 and 2, the valve 138 is shown as being open and block arrows show airflow being directed out of the second outlet 134; while, in FIG. 3, the valve 138 is closed and the lack of the block arrows demonstrates that no airflow is provided from the second outlet 134.

Figure 3:
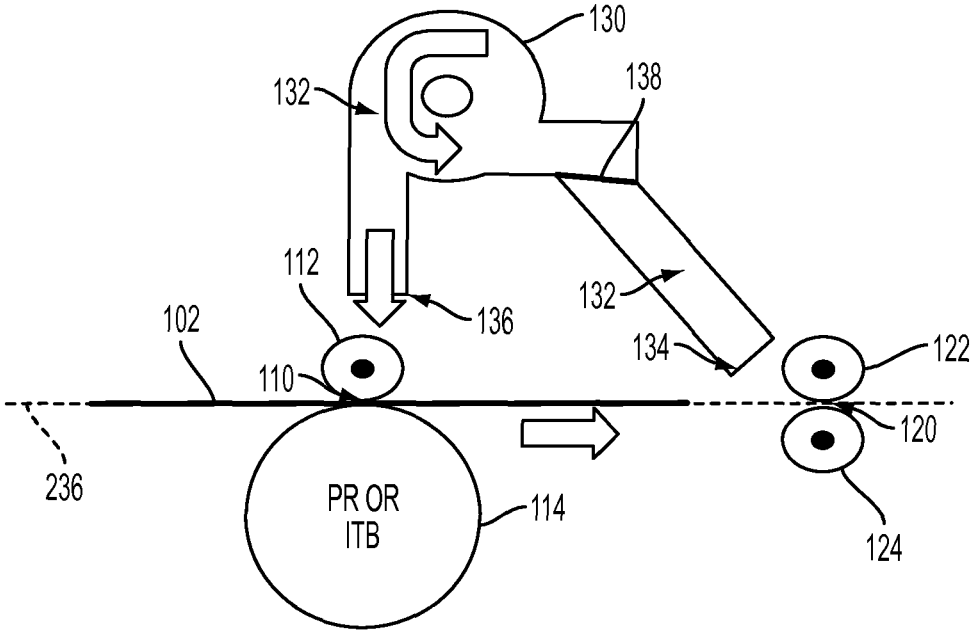
FIG. 3 is a schematic diagram illustrating devices herein.
Figure 4:
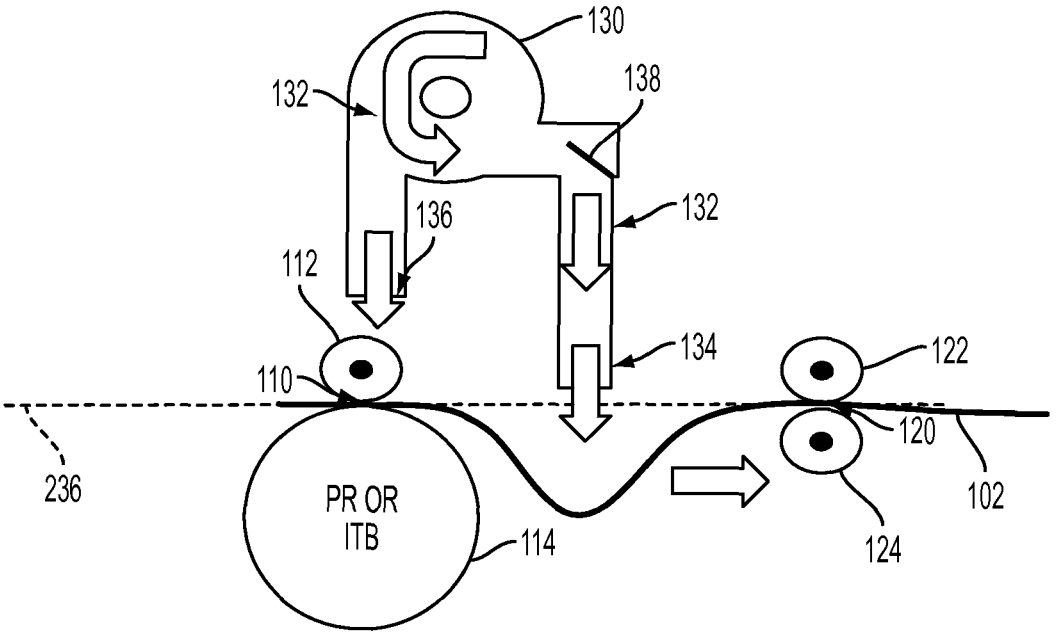
FIG. 4 is a schematic diagram illustrating devices herein.

Further, different configurations (such as that shown in FIGS. 4 and 5) have the second outlet 134 directed to the body of the sheet of media 102 instead of the leading edge (as is shown in FIGS. 1-3). Thus, in FIG. 4, the second outlet 134 directs air toward the middle of the sheet of media 102 (the area between the leading edge and trailing edge) to form the buckle in a specific direction. If needed in the structure in FIG. 4, the valve 138 can be controlled to not direct air at the sheet 102 until the leading edge of the sheet 102 is already held by the fuser nip 120 to prevent the leading edge from being blown away from the fuser nip 120.

Additionally, the processor 224 controls the speed of the blower 130 depending upon a number of conditions including the temperature of the transfer nip 110, the amount by which the print media exceeds such previously established limits on paper weight, thickness, stiffness, length, etc. More specifically, the processor 224 can increase the speed of the blower 130 and/or close the valve 138 in order to direct additional cooling to the transfer nip 110 depending upon the amount by which the transfer nip 110 is outside an acceptable temperature range. Additionally, the processor can increase the speed of the blower 130 and/or change the amount that the valve 138 is open depending upon the amount by which the print media exceeds such previously established limits on paper weight, thickness, stiffness, length, etc. Thus, if the print media greatly exceeds predetermined limits, the valve 138 can be fully opened and the speed of the blower 130 can be increased to a maximum. Similarly, if the temperature of the transfer nip 110 needs to be dramatically lowered, the valve 138 can be completely or partially closed and the speed of the blower can be increased to the maximum. Ranges between such extremes can be balanced depending upon the cooling needs of the transfer nip 110 and the amount by which the media exceeds such previously established limits. Further, when the print media 102 is within limits, and the temperature of the transfer nip 110 is within limits, the valve 138 can be closed and the speed of the blower 130 can be reduced in order to reduce power consumption.

Figure 5:
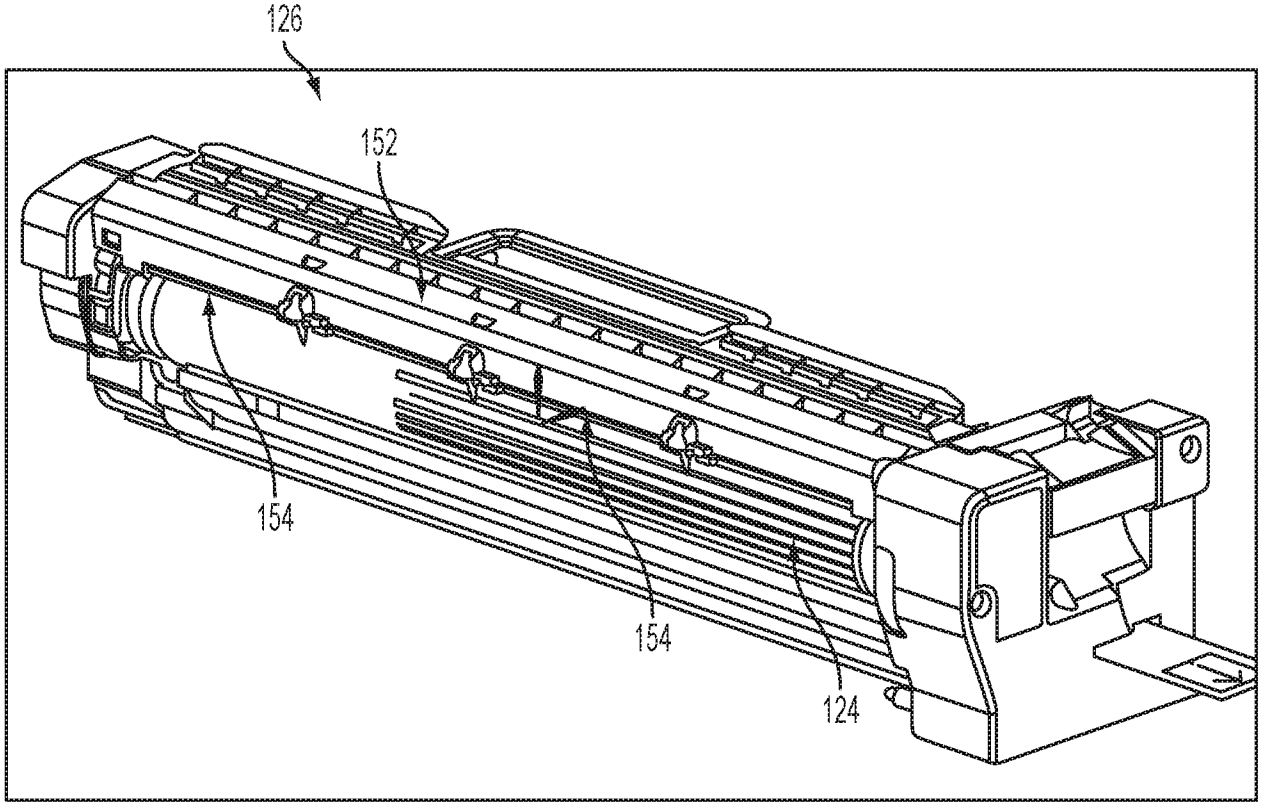
FIG. 5 is a schematic diagram illustrating devices herein.
Figure 6:
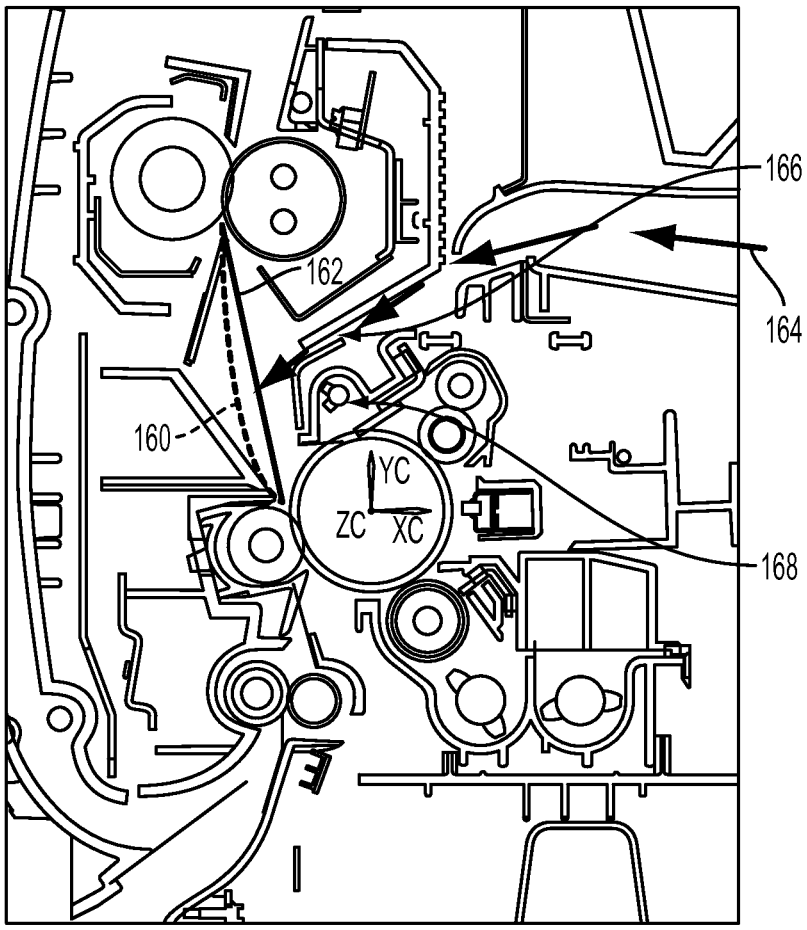
FIG. 6 is a schematic diagram illustrating devices herein.

FIG. 5 illustrates one specific implementation of a fusing station 126 herein. More specifically, FIG. 5 illustrates one of the fuser rolls 124 and a ducting structure 152 that includes air knife outlets 154 that direct air pressure against the leading and trailing edges of the sheets of media 102. Similarly, FIG. 6 illustrates a cross-section of a portion of a printing device, where only some elements are identified by number, to avoid clutter in the drawing. In FIG. 6, airflow 164 along ducts is directed to an element 168 that is to be cooled, and simultaneously airflow is directed out of outlet 166 to change a sheet of media from straight 162 to a curved position 160 (dashed lines) to create the buckle shown in FIGS. 2 and 4, above. While FIGS. 5 and 6 illustrate specific implementations, those ordinarily skilled in the art would understand that the generic schematic drawings shown in FIGS. 1-4 demonstrate that the components herein could be arranged in any manner and that FIGS. 5 and 6 are only some examples of how such components could be arranged.

Figure 7:
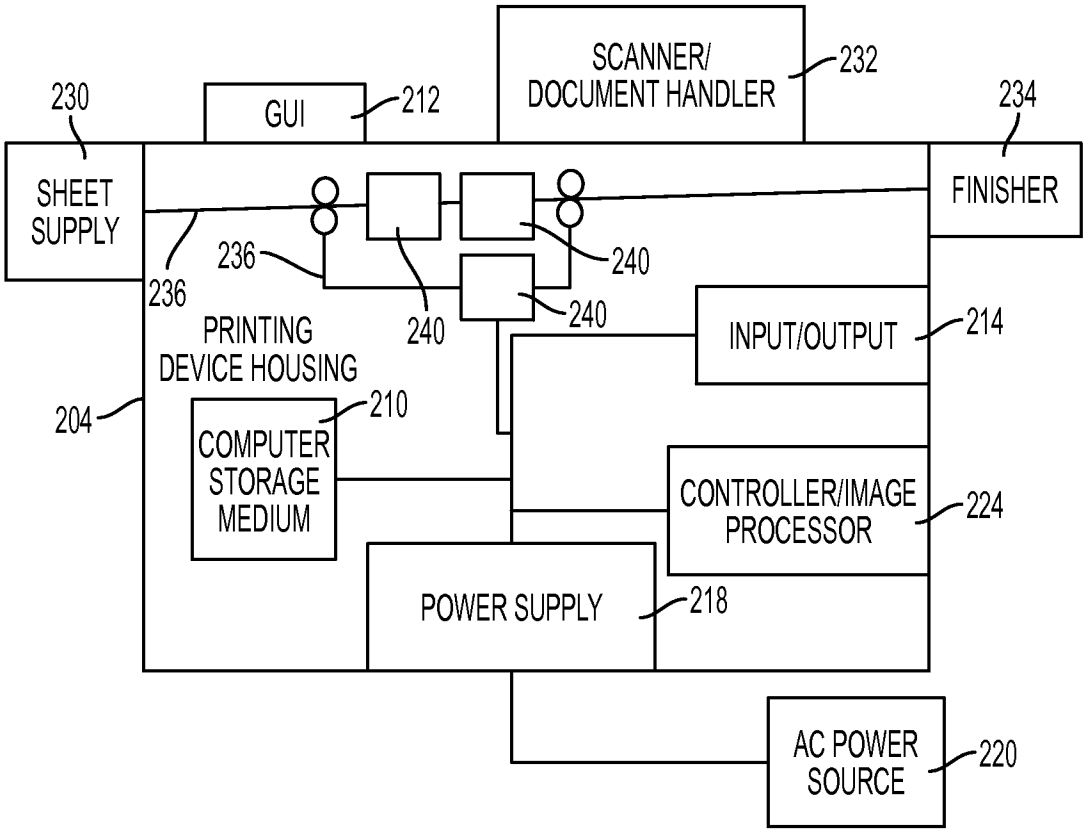
FIG. 7 is a schematic diagram illustrating devices herein.

FIG. 7 illustrates a computerized device that is a printing device 204, which can be used with devices and methods herein and can comprise, for example, a printer, copier, multi-function machine, multi-function device (MFD), etc. The printing device 204 includes a communications port (input/output) 214 operatively connected to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). A specialized image processor 224 (that is different from a general purpose computer because it is specialized for processing image data and controlling internal components of a printing device) controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 7, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 operatively connected to the specialized image processor 224, a media path 236 positioned to supply sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

Figure 8:
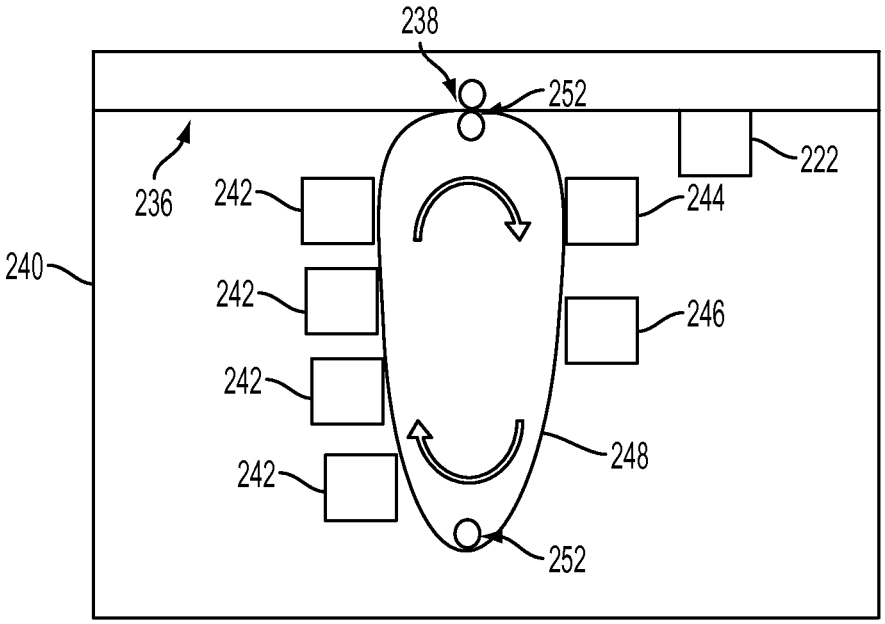
FIG. 8 is a schematic diagram illustrating devices herein.
Figure 9:
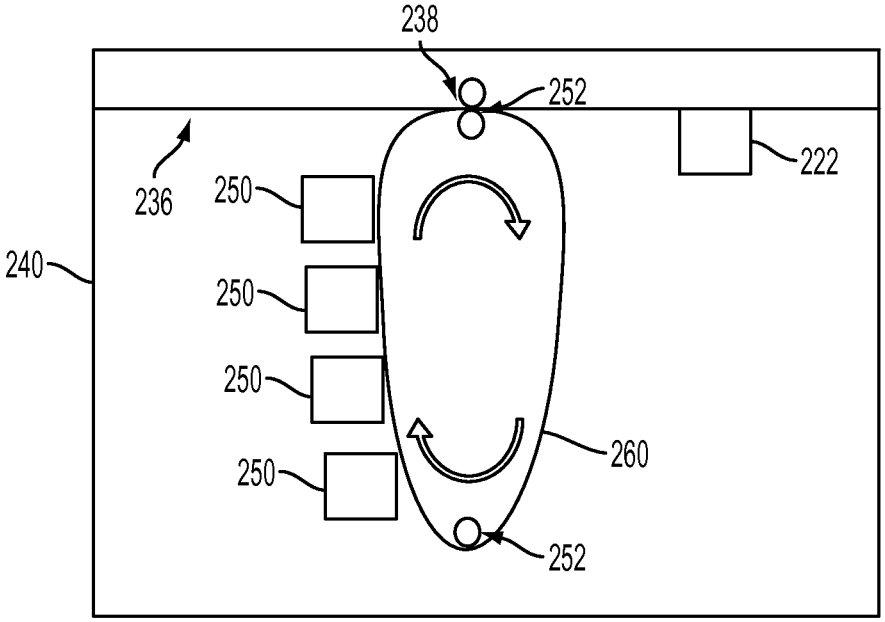
FIG. 9 is a schematic diagram illustrating devices herein.

The one or more printing engines 240 are intended to illustrate any marking device that applies a marking material (toner, inks, etc.) to sheets of media, whether currently known or developed in the future and can include, for example, devices that use a photoreceptor belt 248 (as shown in FIG. 8) or an intermediate transfer belt 260 (as shown in FIG. 9), or devices that print directly to print media (e.g., inkjet printers, ribbon-based contact printers, etc.).

More specifically, FIG. 8 illustrates one example of the above-mentioned printing engine(s) 240 that uses one or more (potentially different color) development stations 242 adjacent a photoreceptor belt 248 supported on rollers 252. In FIG. 8 an electronic or optical image or an image of an original document or set of documents to be reproduced may be projected or scanned onto a charged surface of the photoreceptor belt 248 using an imaging device (sometimes called a raster output scanner (ROS)) 246 to form an electrostatic latent image. Thus, the electrostatic image can be formed onto the photoreceptor belt 248 using a blanket charging station/device 244 (and item 244 can include a cleaning station or a separate cleaning station can be used) and the imaging station/device 246 (such as an optical projection device, e.g., raster output scanner). Thus, the imaging station/device 246 changes a uniform charge created on the photoreceptor belt 248 by the blanket charging station/device 244 to a patterned charge through light exposure, for example.

The photoreceptor belt 248 is driven (using, for example, driven rollers 252) to move the photoreceptor in the direction indicated by the arrows past the development stations 242, and a transfer station 238. Note that devices herein can include a single development station 242, or can include multiple development stations 242, each of which provides marking material (e.g., charged toner) that is attracted by the patterned charge on the photoreceptor belt 248. The same location on the photoreceptor belt 248 is rotated past the imaging station 246 multiple times to allow different charge patterns to be presented to different development stations 242, and thereby successively apply different patterns of different colors to the same location on the photoreceptor belt 248 to form a multi-color image of marking material (e.g., toner) which is then transferred to print media at the transfer station 238.

As is understood by those ordinarily skilled in the art, the transfer station 238 generally includes rollers and other transfer devices. Further, item 222 represents a fuser device that is generally known by those ordinarily skilled in the art to include heating devices and/or rollers that fuse or dry the marking material to permanently bond the marking material to the print media.

Thus, in the example shown in FIG. 8, which contains four different color development stations 242, the photoreceptor belt 248 is rotated through four revolutions in order to allow each of the development stations 242 to transfer a different color marking material (where each of the development stations 242 transfers marking material to the photoreceptor belt 248 during a different revolution). After all such revolutions, four different colors have been transferred to the same location of the photoreceptor belt, thereby forming a complete multi-color image on the photoreceptor belt, after which the complete multi-color image is transferred to print media, traveling along the media path 236, at the transfer station 238.

Alternatively, printing engine(s) 240 shown in FIG. 7 can utilize one or more potentially different color marking stations 250 and an intermediate transfer belt (ITB) 260 supported on rollers 252, as shown in FIG. 9. The marking stations 250 can be any form of marking station, whether currently known or developed in the future, such as individual electrostatic marking stations, individual inkjet stations, individual dry ink stations, etc. Each of the marking stations 250 transfers a pattern of marking material to the same location of the intermediate transfer belt 260 in sequence during a single belt rotation (potentially independently of a condition of the intermediate transfer belt 260) thereby, reducing the number of passes the intermediate transfer belt 260 must make before a full and complete image is transferred to the intermediate transfer belt 260.

Figure 10:
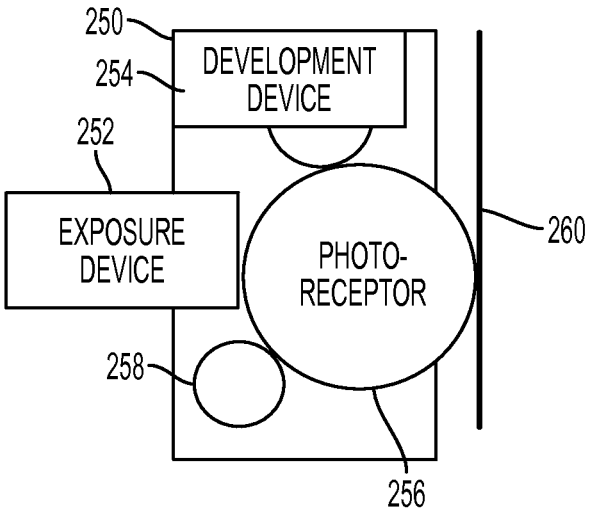
FIG. 10 is a schematic diagram illustrating devices herein.

One exemplary individual electrostatic marking station 250 is shown in FIG. 10 positioned adjacent to (or potentially in contact with) intermediate transfer belt 260. Each of the individual electrostatic marking stations 250 includes its own charging station 258 that creates a uniform charge on an internal photoreceptor 256, an internal exposure device 252 that patterns the uniform charge, and an internal development device 254 that transfers marking material to the photoreceptor 256. The pattern of marking material is then transferred from the photoreceptor 256 to the intermediate transfer belt 260 and eventually from the intermediate transfer belt to the marking material at the transfer station 238.

While FIGS. 8 and 9 illustrate four marking stations 242, 250 adjacent or in contact with a rotating belt (248, 260), which is useful with systems that mark in four different colors such as, red, green, blue (RGB), and black; or cyan, magenta, yellow, and black (CMYK), as would be understood by those ordinarily skilled in the art, such devices could use a single marking station (e.g., black) or could use any number of marking stations (e.g., 2, 3, 5, 8, 11, etc.).

Thus, in printing devices herein a latent image can be developed with developing material to form a toner image corresponding to the latent image. Then, a sheet is fed from a selected paper tray supply to a sheet transport for travel to a transfer station. There, the image is transferred to a print media material, to which it may be permanently fixed by a fusing device. The print media is then transported by the sheet output transport 236 to output trays or a multi-function finishing station 234 performing different desired actions, such as stapling, hole-punching and C or Z-folding, a modular booklet maker, etc., although those ordinarily skilled in the art would understand that the finisher/output tray 234 could comprise any functional unit.

As would be understood by those ordinarily skilled in the art, the printing device 204 shown in FIG. 7 is only one example and the devices and methods herein are equally applicable to other types of printing devices that may include fewer components or more components. For example, while a limited number of printing engines and media paths are illustrated in FIG. 7, those ordinarily skilled in the art would understand that many more media paths and additional printing engines could be included within any printing device used with devices and methods herein.

While some exemplary structures are illustrated in the attached drawings, where like numbers identify the same or similar items, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices and methods herein can encompass devices and methods that print in color, monochrome, or handle color or monochrome image data. All foregoing devices and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. A printing apparatus comprising:

a transfer nip;

a fusing nip located adjacent said transfer nip;

a single blower located adjacent said fusing nip; and two outlets receiving air from said single blower, a first outlet of said two outlets providing air to said transfer nip to reduce a temperature of said transfer nip, and a second outlet of said two outlets selectively directing only identified types of sheets of print media that are approaching said fusing nip toward one side of a media path, said first outlet providing air to reduce said temperature of said transfer nip while said second outlet simultaneously selectively directs said sheets of print media.

2. The printing apparatus according to claim 1, further comprising a valve located between said single blower and said second outlet.

3. The printing apparatus according to claim 2, further comprising a processor operatively connected to said valve, said processor controlling said valve to cause said second outlet to selectively direct only said identified types of said sheets of print media toward said one side.

4. The printing apparatus according to claim 1, said second outlet comprising an air knife.

5. The printing apparatus according to claim 1, further comprising ducting connected to said single blower, said first outlet and said second outlet being within said ducting.

6. The printing apparatus according to claim 1, said transfer nip and said fusing nip being separated by a distance that is less than a length of said sheets of print media, said transfer nip and said fusing nip operating at different sheet feeding speeds to form a buckle in said sheets of print media, and said second outlet directing said sheets of media in a position to properly form said buckle.

7. The printing apparatus according to claim 1, said transfer nip being heated during printing operations, and said first outlet cooling said transfer nip to dissipate heat.

8. A printing apparatus comprising:

a transfer nip;

a fusing nip located adjacent said transfer nip;

a single blower located adjacent said fusing nip; and two outlets receiving air from said single blower, a first outlet of said two outlets providing air to said transfer nip to reduce a temperature of said transfer nip, and a second outlet of said two outlets being located between said transfer nip and said fusing nip and selectively directing only identified types of sheets of print media toward one side of a media path, said first outlet providing air to reduce said temperature of said transfer nip while said second outlet simultaneously selectively directs said sheets of print media.

9. The printing apparatus according to claim 8, further comprising a valve located between said single blower and said second outlet.

10. The printing apparatus according to claim 9, further comprising a processor operatively connected to said valve, said processor controlling said valve to cause said second outlet to selectively direct only said identified types of said sheets of print media toward said one side.

11. The printing apparatus according to claim 8, said second outlet comprising an air knife.

12. The printing apparatus according to claim 8, further comprising ducting connected to said single blower, said first outlet and said second outlet being within said ducting.

13. The printing apparatus according to claim 8, said transfer nip and said fusing nip being separated by a distance that is less than a length of said sheets of print media, said transfer nip and said fusing nip operating at different sheet feeding speeds to form a buckle in said sheets of print media, and said second outlet directing said sheets of media in a position to properly form said buckle.

14. The printing apparatus according to claim 8, said transfer nip being heated during printing operations, and said first outlet cooling said transfer nip to dissipate heat.

15. A printing apparatus comprising:

a media path transporting sheets of print media in a process direction having an end;

a transfer nip located at a first location of said media path;

a fusing nip located at a second location of said media path, said second location being closer to said end in said process direction relative to said first location;

a single blower located adjacent said fusing nip; and two outlets receiving air from said single blower, a first outlet of said two outlets providing air to said transfer nip to reduce a temperature of said transfer nip, and a second outlet of said two outlets being located between said transfer nip and said fusing nip and selectively directing only identified types of said sheets of print media toward one side of said media path, said first outlet providing air to reduce said temperature of said transfer nip while said second outlet simultaneously selectively directs said sheets of print media.

16. The printing apparatus according to claim 15, further comprising a valve located between said single blower and said second outlet.

17. The printing apparatus according to claim 16, further comprising a processor operatively connected to said valve, said processor controlling said valve to cause said second outlet to selectively direct only said identified types of said sheets of print media toward said one side.

18. The printing apparatus according to claim 15, said second outlet comprising an air knife.

19. The printing apparatus according to claim 15, further comprising ducting connected to said single blower, said first outlet and said second outlet being within said ducting.

20. The printing apparatus according to claim 15, said transfer nip and said fusing nip being separated by a distance that is less than a length of said sheets of print media, said transfer nip and said fusing nip operating at different sheet feeding speeds to form a buckle in said sheets of print media, and said second outlet directing said sheets of media in a position to properly form said buckle.

* * * * *